US010286983B1

(12) United States Patent
Coakley

(10) Patent No.: US 10,286,983 B1
(45) Date of Patent: May 14, 2019

(54) CHEVRON RIBBON FAIRING APPARATUS AND METHOD FOR HYDRODYNAMIC VIBRATION AND DRAG REDUCTION

(71) Applicant: David B. Coakley, Alexandria, VA (US)

(72) Inventor: David B. Coakley, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/719,886

(22) Filed: Sep. 29, 2017

Related U.S. Application Data

(60) Provisional application No. 62/447,621, filed on Jan. 18, 2017.

(51) Int. Cl.
*F15D 1/10* (2006.01)
*B63B 21/66* (2006.01)

(52) U.S. Cl.
CPC ..... *B63B 21/663* (2013.01)

(58) Field of Classification Search
CPC .... B63B 21/66; B63B 21/663; B63B 2021/66
USPC ..... 114/243
See application file for complete search history.

(56) References Cited

U.S. PATENT DOCUMENTS 3,467,047 A * 9/1969 Behr ..... B63B 21/663 114/243
4,542,708 A * 9/1985 Holcombe ..... B63B 21/663 114/243
4,567,841 A * 2/1986 Hale ..... B63B 21/663 114/221 R
2010/0212573 A1* 8/2010 Hawkes ..... B63B 22/24 114/328
2010/0212574 A1* 8/2010 Hawkes ..... B63C 11/42 114/328
2017/0334526 A1* 11/2017 Godoy ..... B63B 21/663

* cited by examiner

*Primary Examiner* — Daniel V Venne
(74) *Attorney, Agent, or Firm* — Charles D. Buskey; Dave A. Ghatt

(57) ABSTRACT

The invention is a chevron ribbon fairing that reduces hydrodynamic drag on marine cables towed by a vessel. The fairing is the shape of a "V," with an angle between the legs of the "V" chosen on the basis of the predicted cable angle relative to the flow. The chevron angle is twice the cable angle. The tip of chevron ribbon fairing is woven into the outer armor strands of the steel cable or molded to a jacketed cable. When the cable is at shallow angles to the fluid flow, the fairing aligns with the flow, a presents a reduced cross sectional area to the fluid flow behind the towed cable. The chevron design allows the ribbon to naturally align with the fluid flow even as the ribbon rotates about its axis. This ensures a reduction in tangential drag regardless of the level of cable tension.

20 Claims, 5 Drawing Sheets

CHEVRON RIBBON FAIRING APPARATUS AND METHOD FOR HYDRODYNAMIC VIBRATION AND DRAG REDUCTION

BENEFIT OF PROVISIONAL APPLICATION FILING DATE UNDER 35 U.S.C § 120

This patent application claims benefit of Provisional Patent Application No. 62/447,621, filed on Jan. 18, 2017 by the same inventor.

STATEMENT OF GOVERNMENT INTEREST

The invention described herein may be manufactured and used by, or for the Government of the United States of America, for governmental purposes without payment of any royalties thereon or therefore.

RELATED APPLICATIONS

This patent application is related to the patent application entitled "Cable Sandwich Ribbon Fairing," filed by the United States Department of the Navy.

BACKGROUND

Cable fairings are structures attached to cables typically towed by marine vessels. They are designed to streamline the water flow around the cable and reduce normal drag and cable vibration caused by vortex shedding. Faired cables are used in applications such as underwater geophysical exploration and military reconnaissance operations, including towing buoys from ships, submarine detection, and deploying radio antennas from submarines. Rectangular ribbon fairings are the most popular type of fairings used to reduce vortex induced vibration and normal drag. Normal drag is the component of cable drag that is perpendicular to the cable axis. Conversely, tangential drag is the component of drag parallel to the cable axis.

Prior art FIG. 1 shows a commonly used ribbon fairing (100). The ribbon fairing (100) is a rectangular piece of material that is typically woven into the outer armor layer of a towed cable, as shown in prior art FIG. 2. The fairing is held by one or two strands of the outer layer of cable armor such that it is folded along its center line (105) and extend back in the wake of the cable. The fairings can also be molded onto a polymer jacket of a cable.

While ribbon fairings can be effective in reducing normal drag and cable strum, they introduce tangential drag when the tow angle is less than 90 degrees to the flow. This is because ribbon fairings naturally lie close to 90 degrees to the cable axis as shown in prior art FIG. 2. Consequently, as the tow angle decreases, more of the cross sectional area of the ribbon fairing is presented to the flow.

This increased cross sectional area becomes more problematic as the cable tension increases and the tow angle gets closer to horizontal. At angles of 30 degrees or less, the tangential drag of the rectangular ribbon fairing increases significantly. In fact, rectangular fairing tangential drag at these angles is typically ten times, or more, the tangential drag of the bare cable. Since each strip is held at its center (105) by the outer armor strands of the cable (210), the rectangular fairing warps or twists as the tow angle of the cable decreases and the ribbon tries to align with the flow. Consequently, instead of presenting a frontal area of t×w to the flow, where t is the ribbon thickness and w is the ribbon width, the rectangular fairing presents a frontal area on the order of w×w.

At more shallow cable angles, this tangential drag from the ribbon fairing can significantly increase the tow tension on the cable at the tow vessel. As a result, ribbon fairings are typically not used at angles shallower than 20-30 degrees. Therefore, there is a need for a fairing that reduces normal drag at shallow angles without introducing high levels of tangential drag.

SUMMARY

This invention provides a solution to the issue of increased tangential drag with a reduced cable angle to the flow by providing a chevron ribbon fairing, which can significantly reduce the hydrodynamic vibration and drag on the tow cable. As the name implies, the chevron ribbon fairing is shaped like the letter "V." The vertex or tip of the chevron ribbon fairing is woven into strands of the outer armor of the steel towing cable or molded to a jacketed towing cable, leaving the two legs of the chevron free. When the cable is towed at a shallow angle for which the chevron fairing is designed, the chevron ribbon aligns with the flow so that the cross sectional area presented to the flow from each leg is near t×w, where, t is the chevron ribbon leg thickness and w is the chevron ribbon leg width. This results in a significant decrease in tangential drag.

The chevron design allows the legs of the ribbon to naturally align with the flow even as the cable rotates about its axis due to changes in applied tension. When the cable is at a predetermined acute towing angle, for which the chevron fairing is designed, the fairing aligns with the flow, thereby reducing its cross sectional area to the flow. This ensures a reduction in tangential drag regardless of the level of cable tension.

The chevron ribbon fairing design is most effective when its vertex angle is twice the cable's towing angle to the flow. The chevron fairing vertex angle can be designed to accommodate any tow angle between approximately 10-90 degrees. However, the chevron ribbon fairing will typically be used for more acute tow cable angles relative to the flow. For example, in an embodiment where the cable angle is 15 degrees relative to the flow, the vertex of the chevron fairing will have an angle of 30 degrees and be woven into the outer armor of the cable.

The chevron fairing (like normal ribbon fairings) can be made from a variety of a pliable materials, such as polyurethane, a fiber reinforced polymer, cloth, plastic, etc.

DRAWINGS

DETAILED DESCRIPTION

Figure 1:
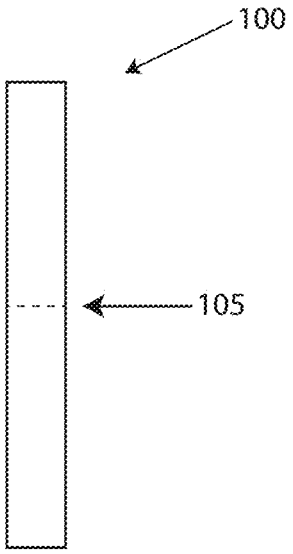
Figure 1 (Prior Art)
FIG. 1 (Prior Art) is a prior art rectangular cable ribbon fairing.
Figure 2:
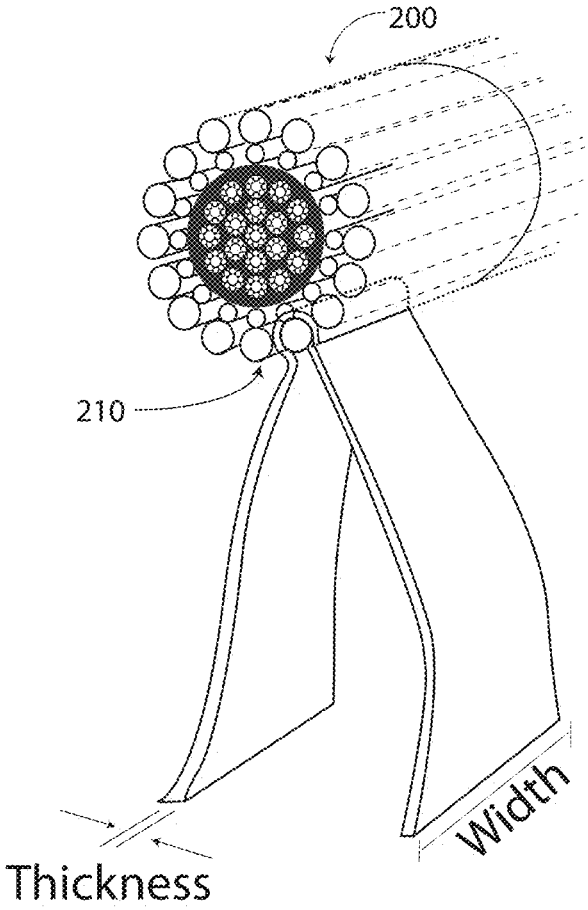
Figure 2 (Prior Art)
FIG. 2 (Prior Art) is a perspective view of prior art rectangular cable ribbon fairings woven into the armor of a tow cable.
Figure 3:
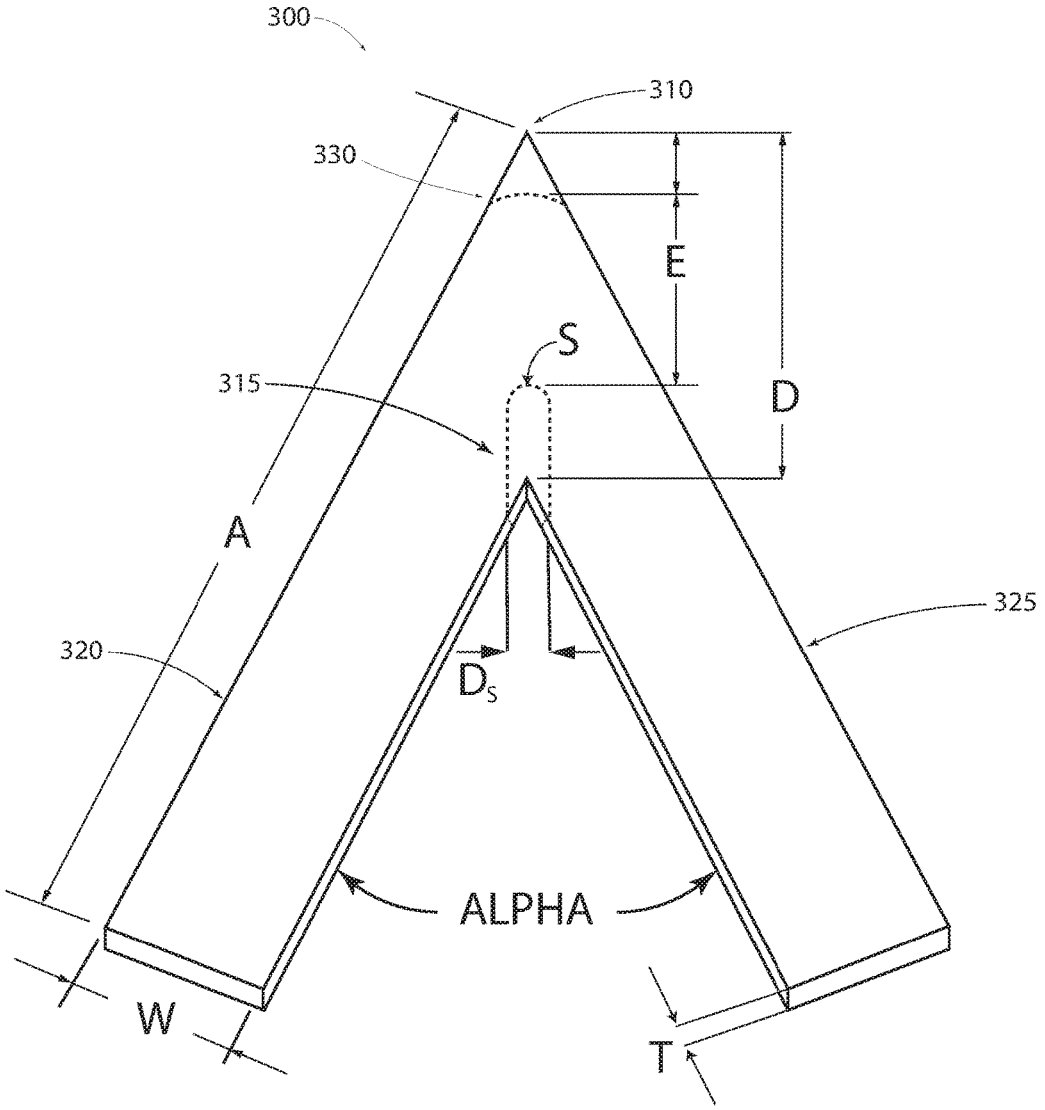
FIG. 3 shows the geometry and principle dimensions of the preferred embodiment of the chevron ribbon fairing.

Referring to FIG. 3, the principal geometry and dimensions of an embodiment of the chevron ribbon fairing (300)

is shown. The fairing (300) has an outer vertex (310), an inner crotch vertex (315), a first leg (320) and a second leg (325). The length (D) or (E) of material between the outer vertex (310) and the inner crotch vertex (315) gets woven into the armor of the cable. Both legs have a width (W) and thickness (T). The inner crotch vertex has an angle (ALPHA) between the first leg (320) and the second leg (325). The chevron's inner crotch vertex angle (ALPHA) varies with to the cable tow angle. For optimal performance, the inner crotch vertex angle (ALPHA) should be two times the tow angle of the cable. The length (A) of the first leg (315) and the second leg (320) should be sufficient to reduce vortex shedding to an acceptable degree. This length (A) is typically 3 to 8 times the cable diameter (D). Thus, with smaller cable diameters, shorter fairing leg lengths are used.

FIG. 3 also shows the preferred embodiment of the chevron ribbon fairing (300) with a rounded fillet (S) that extends into the inner crotch vertex (315). The rounded fillet (S) reduces the amount of material of each chevron leg (320) and (325) woven into the armor of the cable. It also reduces the concentration of stress on the fairing at the cable if either of the legs (320) or (325) is caught and pulled while going through tow cable equipment such as winches, rollers, or sheaves. The fillet (S) has a diameter ($D_s$) that is approximately equal to one or two outer armor strand diameters of the cable, or approximately 10 percent of the diameter of the cable.

Figure 4:
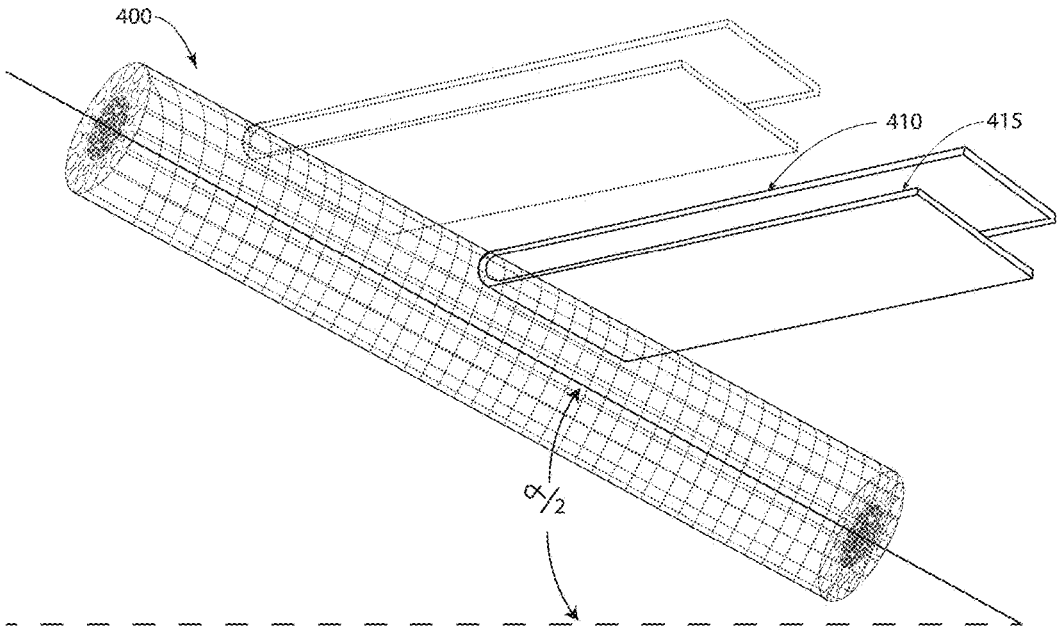
FIG. 4 shows the preferred embodiment of the chevron ribbon fairing with the vertex woven into the outer layer of an armored cable.

In addition to the rounded fillet (S), the tip of the vertex (310) can be altered to create a more flattened or rounded vertex (330) to facilitate weaving the fairing into the armored cable. If it is attached to a smooth jacket of a polymer cable, via molding, gluing etc., the pointed top vertex is preferred. The rounded vertex (330) and rounded fillet (S) shorten the vertex length from length (D) to length (E) as shown in FIG. 4. Table I below shows the preferred dimensions of the chevron as a function of the inner crotch vertex angle (ALPHA) and the cable diameter ($D_c$).

TABLE 1

| Cable Diameter | Angle of Cable | Alpha | W | A | D | E | S |
|---|---|---|---|---|---|---|---|
| — | deg | deg | in | in | in | in | in |
| $D_c$ | $\alpha/2$ | $\alpha$ | $D_c$*sin($\alpha$/2) | 7*$D_c$ | 1.2*$D_c$ | 1.1*$D_c$ | 0.1*$D_c$ |

Figure 5:
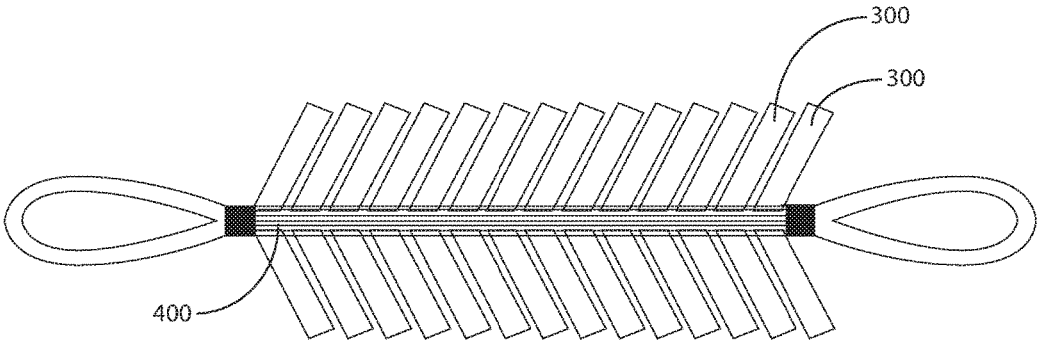
FIG. 5 shows multiple chevron ribbon fairings woven into the armor of a tow cable.

The chevron ribbon fairing (300) is employed as shown in FIG. 5. The vertex (405) of the chevron ribbon fairing is woven into one or more of the outer armor strands of the cable (400), leaving the legs (410) and (415) free to extend in the same plane, behind the cable. The cable is being towed at an angle of ($\alpha$/2) degrees. Because the vertex angle ($\alpha$) of the chevron ribbon fairing is twice the towing angle ($\alpha$/2) of the cable, when the vertex fairing is woven into the armor of the cable (400) the legs (410) and (415) align with the flow behind the cable, with each leg presenting a cross sectional area to the flow of approximately t×w, where, t is the chevron ribbon leg thickness and w is the chevron ribbon leg width. FIG. 5 shows multiple chevron ribbon fairings installed on stationary a tow cable.

All embodiments of the chevron ribbon fairings can be made from a variety of materials. Any flexible material such as cloth, composite reinforced polyurethane, rubber, polyethylene, or the like can be used.

Although the invention has been described in detail with particular reference to these preferred embodiments, other embodiments can achieve the same results. Variations and modifications of the present invention will be obvious to those skilled in the art and it is the intent of this application to cover, in the appended claims, all such modification and equivalents. The entire disclosure and all references, applications, patents, and publications cited above are hereby incorporated by reference.

What is claimed is:

1. A ribbon fairing for an armored cable, wherein the armored cable is towed at a given angle to a flow and has a given diameter, the ribbon fairing comprising:
- a vertex comprising:
  - an outer point; and
  - an inner crotch;
- a first leg extending from the vertex at an angle; and
- a second leg, wherein the first leg and the second leg extend in the same plane, and wherein the second leg extends from the vertex at an angle equal to and opposite the angle of the first leg to create a total angle between the first and the second leg that is twice the angle from which each of the first leg and the second leg extends from the vertex.

2. The ribbon fairing of claim 1, wherein the vertex of the ribbon fairing is woven around the armor of the cable such that the first leg and the second leg extend from the armor of the cable, behind the cable, parallel to each other.

3. The ribbon fairing of claim 2, wherein the length of the first leg and the length of the second leg are in a range of three to eight times the diameter of the armored cable.

4. The ribbon fairing of claim 1, wherein the total angle between the first leg and the second leg is approximately twice the given angle at which the cable is towed to the flow of water.

5. The ribbon fairing of claim 1, wherein the ribbon fairing is composed of a pliable material.

6. The ribbon fairing of claim 5, wherein the pliable material comprises any of the following: plastics composites, polyurethane, polyethylene, cloth, fiber, reinforced fabric, fiber reinforced rubber, or fiber reinforced plastic.

7. A ribbon fairing for an armored cable, wherein the armored cable has a given diameter, and wherein the armored cable is towed at a given angle to a flow, the ribbon fairing comprising:
- a vertex comprising:
  - an outer point; and
  - an inner crotch, wherein the inner crotch of the vertex forms a fillet having a fillet diameter, wherein the fillet diameter is equal to approximately 10 percent of the diameter of the armored cable;
- a first leg extending from the vertex at an angle; and
- a second leg, wherein the first leg and the second leg extend in the same plane, and wherein the second leg extends from the vertex at an angle equal to and opposite the angle of the first leg to create a total angle between the first leg and the second leg that is twice the angle from which each of the first leg and the second leg extends from the vertex.

8. The ribbon fairing of claim 7, wherein the vertex of the ribbon fairing is woven into the armor of the cable such that the first leg and the second leg extend from the armor of the cable, behind the cable, parallel to each other.

9. The ribbon fairing of claim 7, wherein the length of the first leg and the length of the second leg are in a range of three to eight times the diameter of the armored cable.

10. The ribbon fairing of claim 7, wherein the total angle between the first leg and the second leg is twice the given angle at which the cable is towed to the flow of water.

11. The ribbon fairing of claim 7, wherein the ribbon fairing is composed of a pliable material.

12. The ribbon fairing of claim 7, wherein the pliable material comprises any of the following: plastic composites, polyurethane, polyethylene, cloth, fiber, reinforced fabric, fiber reinforced rubber, or fiber reinforced plastic.

13. A method for reducing the hydrodynamic drag on an armored cable, wherein the cable has a given diameter, and wherein the cable is towed at a given angle to a flow of water, the method comprising:

weaving a vertex of a chevron ribbon fairing into armor of the armored cable, wherein the chevron ribbon fairing comprises:

a vertex comprising:

an outer point; and an inner crotch;

a first leg extending from the vertex at an angle; and a second leg, wherein the first leg and the second leg extend in the same plane, and wherein the second leg extends from the vertex at an angle equal to and opposite the angle of the first leg to create a total angle between the first and the second leg that is twice the angle from which each of the first leg and the second leg extends from the vertex.

14. The method of claim 13, wherein the length of the first leg and the length of the second leg are in a range of three to eight times the diameter of the armored cable.

15. The method of claim 13, wherein the total angle between the first leg and the second leg is approximately twice the given angle at which the cable is towed to the flow of water.

16. The method of claim 13, wherein the chevron ribbon fairing is composed of a pliable material.

17. The method of claim 16, wherein the ribbon fairing pliable material comprises any of the following: plastics composites, polyurethane, polyethylene, cloth, fiber reinforced fabric, fiber reinforced rubber, or fiber reinforced plastic.

18. The method of claim 13, wherein the vertex of a chevron ribbon fairing is woven into armor of the armored cable such that the first leg and the second leg extend from the armor of the cable, behind the cable, parallel to each other.

19. The method of claim 13, wherein strands of the outer armor of the cable have a given diameter, and wherein the inner crotch point of the vertex is forms a fillet with a radius equal to approximately one or two if the outer armor strand diameters of the cable.

20. The method of claim 13, wherein the cable has a given diameter, and wherein the inner crotch point of the vertex forms a fillet with a diameter equal to approximately 10 percent of the diameter of the cable.

* * * * *